US011485626B2

(12) United States Patent
Benson, Jr. et al.

(10) Patent No.: US 11,485,626 B2
(45) Date of Patent: Nov. 1, 2022

(54) SMART FUEL NOZZLE

(71) Applicant: New York Air Brake LLC, Watertown, NY (US)

(72) Inventors: George S. Benson, Jr., Jacksonville Beach, FL (US); Michael J. Barton, Nixa, MO (US); Andrew C. Minor, Springfield, MO (US)

(73) Assignee: New York Air Brake LLC, Watertown, NY (US)

( * ) Notice: Subject to any disclaimer, the term of this patent is extended or adjusted under 35 U.S.C. 154(b) by 234 days.

(21) Appl. No.: 17/027,061

(22) Filed: Sep. 21, 2020

(65) Prior Publication Data

US 2022/0089430 A1 Mar. 24, 2022

(51) Int. Cl.

| | |
|---|---|
| ***B67D 7/04*** | (2010.01) |
| ***B67D 7/14*** | (2010.01) |
| ***B61C 17/02*** | (2006.01) |

(52) U.S. Cl.

CPC ..... *B67D 7/04* (2013.01); *B61C 17/02* (2013.01); *B67D 7/145* (2013.01)

(58) Field of Classification Search

CPC ..... B67D 7/04; B67D 7/145; B61C 17/02

See application file for complete search history.

(56) References Cited

U.S. PATENT DOCUMENTS

| | | | | |
|---|---|---|---|---|
| 2015/0321898 | A1* | 11/2015 | Weepie | B67D 7/46 141/206 |
| 2016/0347602 | A1* | 12/2016 | Clever | B67D 7/42 |
| 2018/0029872 | A1* | 2/2018 | Garrison | B67D 7/344 |

* cited by examiner

*Primary Examiner* — Jason K Niesz
(74) *Attorney, Agent, or Firm* — David Nocilly

(57) ABSTRACT

A nozzle for delivering fuel from a fueling station that can be remotely triggered to shut-off prior to the receiving fuel tank being filled. The nozzle includes a valve that can be opened by a lever and latched into the open position for continuous filling. The nozzle handle has an actuator positioned to cause the latch to release the lever and a controller that can energize the actuator in response to receipt of a wireless signal indicating that the delivery of fuel should be terminated. A wireless communication interface of the nozzle is in wireless communication with a fuel management system that can monitor a fuel flow meter to signal the nozzle to shut-off when the amount of fuel that has been delivered reaches a predetermined amount.

14 Claims, 8 Drawing Sheets

SMART FUEL NOZZLE

BACKGROUND OF THE INVENTION

1. Field of the Invention

The present invention relates to locomotive refueling systems and, more specifically, to a fuel nozzle having a wirelessly controlled actuator that can release the latch of the nozzle valve lever.

2. Description of the Related Art

Diesel locomotives are typically refueled using wayside fueling stations. A fueling station may have one or more fueling cranes, each of which has a counterbalanced and articulated boom that supports a nozzle and that can be extended over the railroad tracks to position the nozzle in a locomotive fuel tank. The other end of the crane is pivotally mounted to a fuel supply station that can deliver fuel through the boom to the nozzle and thus the locomotive fuel tank. The fuel supply station may include a fuel meter for tracking the amount of fuel being delivered. The nozzle includes a conventional vacuum shutoff that will stop fuel from dispensing through the nozzle when the locomotive fuel tank is full. However, there may be times when it is not necessary to completely fill a locomotive fuel tank and thus the dispensing of fuel from the fuel supply station must be stopped before the locomotive fuel tank is full.

Conventional approaches to shutting off fuel delivery to a locomotive prior to the fuel tank becoming full, referred to as short fueling, requires the use of a shutoff valve (commonly referred to as a control valve) at the fuel supply station. The control valve is electrically coupled to the meter and is configured to shut off fuel delivery in response an electronic signal received from the meter when the meter reaches a predetermined amount. The problem with this approach, however, is that fuel in the boom and nozzle is free to continue flow out of the nozzle. The emptying of fuel from the boom and nozzle presents many problems, including unbalancing of the articulated boom that is counterbalanced based on the weight of the boom having fuel within it. As a result, there is a need in the art for an approach that can allow for short fueling without allowing fuel in the boom and nozzle to be freely dispensed from the nozzle.

BRIEF SUMMARY OF THE INVENTION

The present invention comprises a smart fuel delivery system that can automatically shut-off fuel delivery at the fuel nozzle prior to the fuel tank become full in response to a remote signal indicating that a predetermined amount of fuel has been delivered to a fuel tank, such as when short fueling a locomotive. As a result, any undelivered fuel remains in the nozzle and associated fuel boom, thereby maintaining the proper counterbalancing and preventing any further flow through the nozzle.

More specifically, the present invention comprises a nozzle body defining a flow path for the delivery of fuel therethrough, a valve positioned in the flow path and moveable between a closed position and an open position in response to movement of a lever from a first position to a second position, a latch for retaining the lever in the second position so that the valve is maintained in the open position, a handle coupled to the body and supporting an actuator positioned to cause the latch to release the lever when the actuator is energized, and a controller mounted to the handle and programmed to energize the actuator in response to receipt of a wireless signal indicating that the delivery of fuel should be terminated. A first wireless communication interface is coupled to the controller and configured to engage in wireless communications with a remote host. The handle includes a power source interconnected to the controller and the actuator. The remote host comprises a fuel management system associated with a fuel supply station having a boom that supports the nozzle body and delivers fuel through the flow path of the body. A fuel meter associated with the fuel supply station. The fuel management system is coupled to the fuel meter and includes a microprocessor that is coupled to the fuel meter as well as a second wireless communication interface coupled to the microprocessor that is in communication with the first wireless communication interface. The microprocessor is programmed to wirelessly transmit the wireless signal indicating that the delivery of fuel should be terminated to the controller when the fuel meter indicates a predetermined amount of fuel has been delivered through the flow path. The fuel delivery system further comprises a first visual indicator that provides an indication of the status of wireless communications between the first wireless communication information and the second wireless communication interface. The fuel delivery system additionally comprises a second visual indicator that provides an indication of a low level of power available from the power source.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
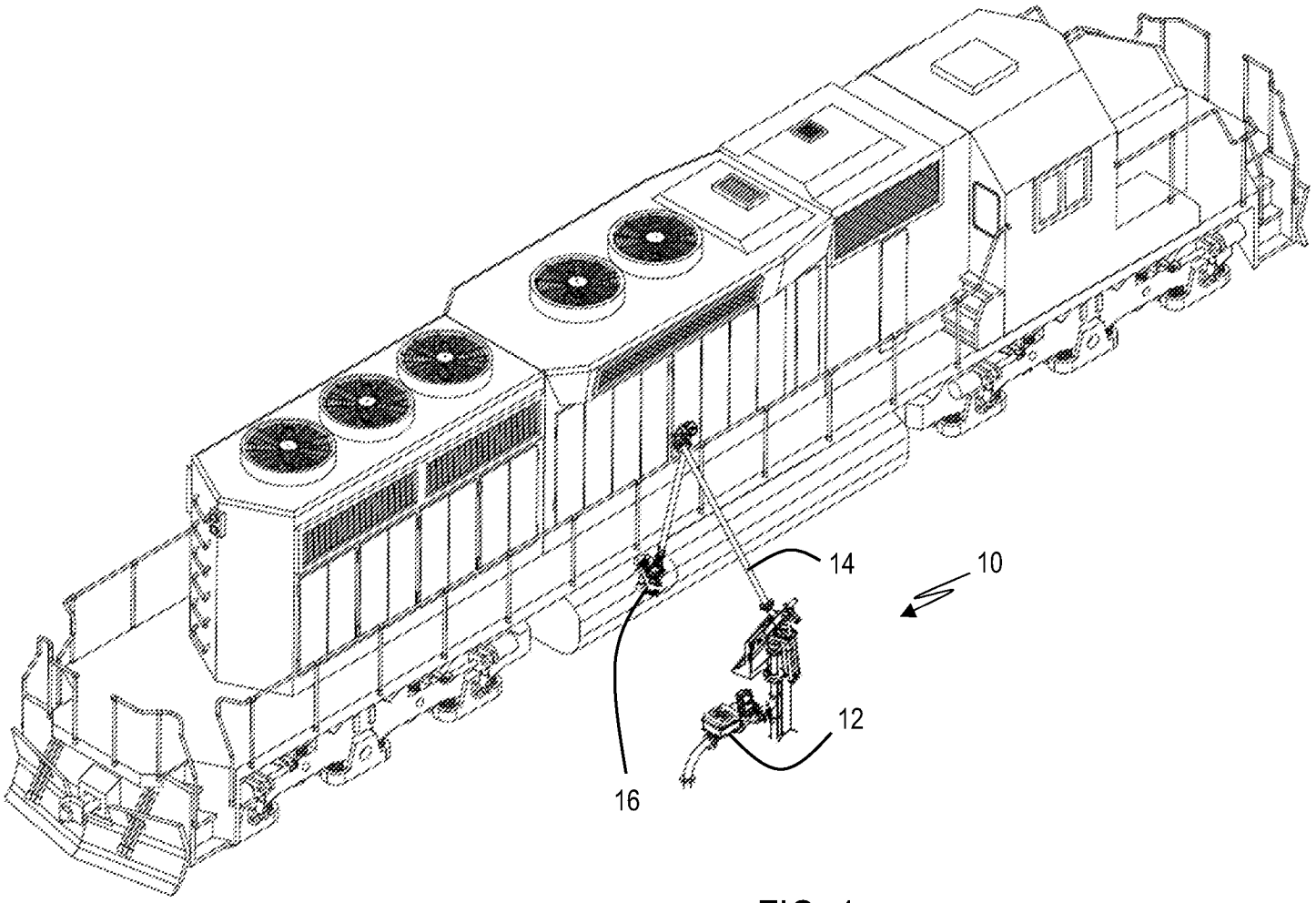
FIG. 1 is a schematic of a wayside fueling station of a locomotive having a boom and a fuel nozzle according to the present invention.

Referring to the figures, wherein like numeral refer to like parts throughout, there is seen in FIG. 1 a fueling station 10 for a locomotive having an fuel supply station 12, an articulated and counterbalanced boom 14 coupled to fuel supply station 12, and a nozzle 16 positioned at the end of the boom 14 that can be selectively extended to deliver fuel to a locomotive fuel tank.

Figure 2:
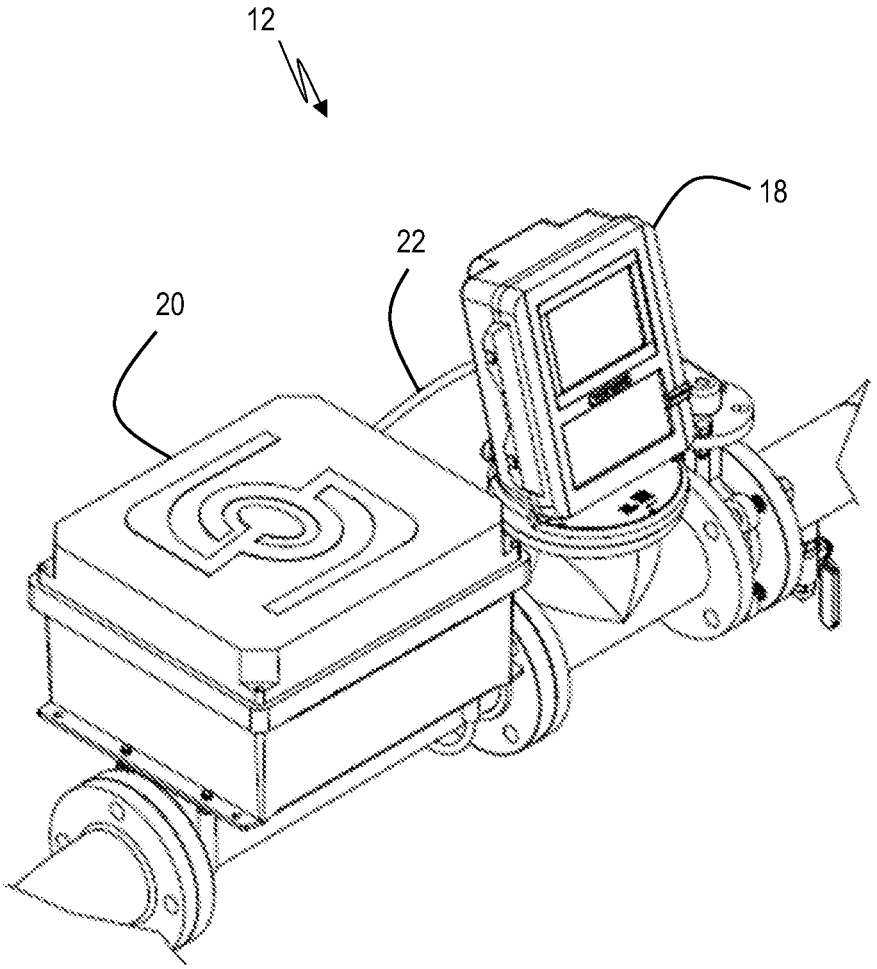
FIG. 2 is a schematic of a fuel supply station having a fuel management system in wireless communication with a fuel nozzle according to the present invention.

Referring to FIG. 2, fuel supply station 12 includes a fuel meter 18 that tracks the amount of fuel being delivered to the locomotive fuel tank via fuel supply station 12 and nozzle 16. Fueling station 10 further comprises a fuel management system 20 electrically coupled to fuel meter 18, such as by a wire 22. Fuel meter 18 can send an electrical signal representing a predetermined amount of fuel, as set by a user into fuel meter 18, has been delivered to the locomotive fuel tank by fuel supply station 12. Fuel management system 20 is thus electrically coupled to fuel meter 18 to receive signal from fuel meter 18 regarding the amount of fuel being delivered to the locomotive fuel tank.

Figure 3:
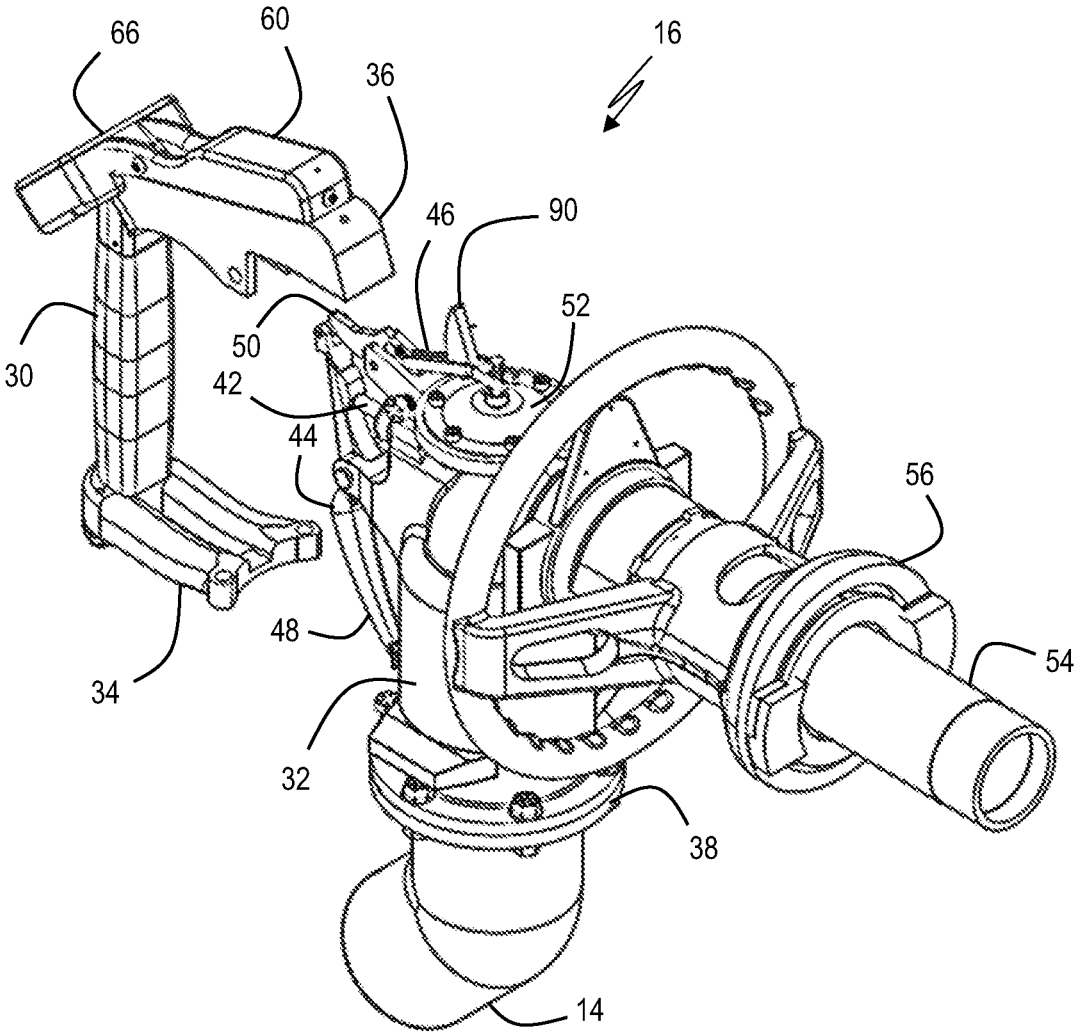
FIG. 3 is a perspective view of a fuel nozzle according to the present invention.
Figure 4:
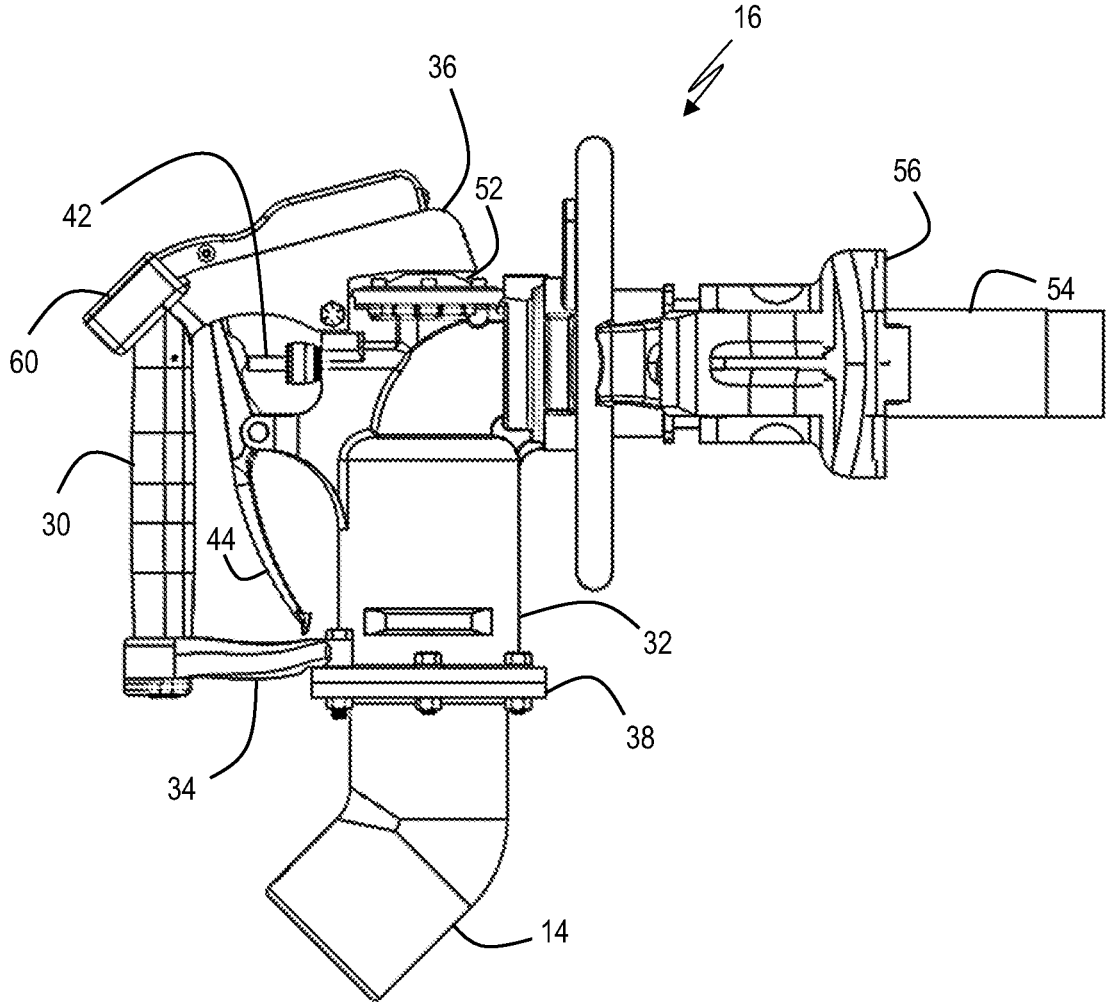
FIG. 4 is a side view of a fuel nozzle according to the present invention.

Referring to FIGS. 3 and 4, nozzle 16 coupled to the end of boom 14 comprises a handle 30 coupled to and spaced apart from a nozzle body 32. Nozzle body 32 a conventional nozzle body having a coupler 38 for interconnection to boom 14 and a flow path through which fuel may pass from boom 14 through nozzle body 32 to the locomotive fuel tank. Nozzle 16 includes a normally closed valve 40 positioned in body 32 that can selectively allow or prevent the flow of fuel through fuel path of body 32. Valve 40 is normally biased into a closed position that prevents the flow of fuel through body 32 and may be driven into the open position by the application of force to post 42. A lever 44 is pivotally mounted along an intermediation portion of body 32. Lever 44 includes an actuating portion 46 that can engage post 42 and thus drive valve 40 into the open position when the opposing end 48 of lever 44 is moved by a user.

As further seen in FIGS. 3 and 4, handle 30 includes a latch 50 that can retain an upper end 58 of lever 44 in the actuated position so that valve 40 is held open for continuous fueling without the need for a user to continuously apply a force to lever 44. Handle 30 further includes a vacuum release 52 interconnected to latch 50 to provide a conventional automatic shut-off system where a sensing port at the end of a spout 54 of nozzle 16 will cause the vacuum release 52 to unlatch latch 50 when the locomotive fuel tank becomes full and blocks the sensing port (not shown). A locking ring 56 may be included for coupling nozzle 16 in place when spout 54 has been inserted into a locomotive fuel tank.

Figure 5:
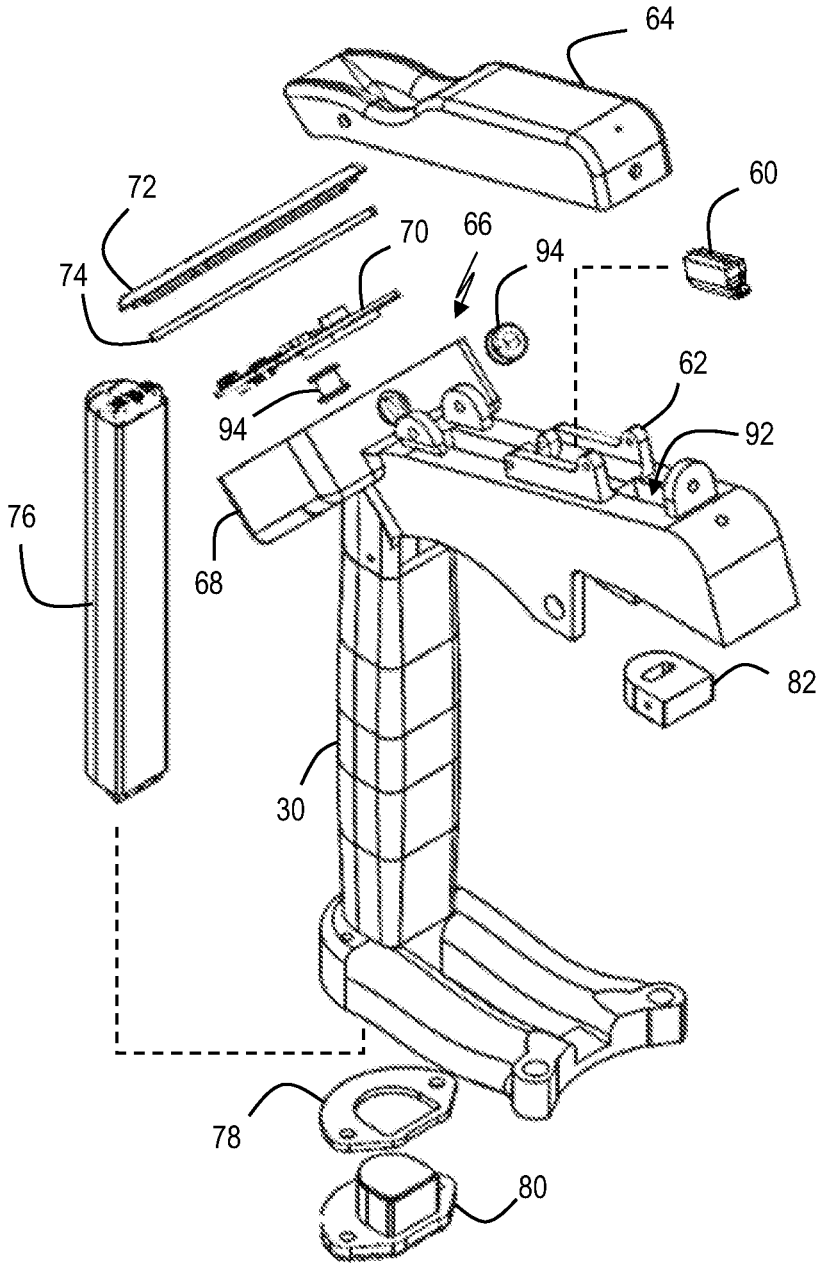
FIG. 5 is an exploded view of a handle for a fuel nozzle according to the present invention.

Referring to FIG. 5, handle 30 is coupled to nozzle body 32 via a lower foot 34 and an upper housing 36. Upper housing 36 supports an actuator 60 that is positioned to selectively engage a release trigger 90 interconnected to latch 50. Actuator 60 may comprise, for example, a micro linear 6 volt actuator. Actuation of release trigger 90 by actuator 60 will cause the release of lever 44 if lever 44 has been latched by latch 50. Actuator 60 is electrically coupled to a controller 66 mounted to handle 30 that can wirelessly receive and respond to a signal from fuel management system 20 that the predetermined amount of fuel has been delivered. Actuator 60 is mounted to a receiver 62 formed within upper housing 36 such as by using set screws and can include adjustment screws to assist with proper orientation of actuator 60 within receiver 62 so that actuator 60 aligns properly to actuate release trigger 90. Receiver 62 is positioned adjacent to an opening 92 in upper housing that accepts release trigger 90 so that actuator 60 can impact release trigger 90 when energized by controller 66. A cover 64 can be attached to enclose upper housing 36 and protect actuator 60. Controller 66 includes a printed circuit board 70 that is mounted in controller housing 66 and supports the electronics for controlling actuator 60 in response to wireless communications with fuel management system 20. Controller housing 68 is enclosed by a cover 72 that can be mounted over controller housing 68 and can include a gasket 74 for sealing controller housing 68 from the environment. Controller 66 is interconnected to a power source 76, such as a battery pack, that may be positioned within handle 30 and secured in place with a gasket 78 and bottom cap 80 secured in place, such as with screws. A battery contact pad 82 is mounted within handle 30 to engage the contracts of power source 76 and provide power to controller 66. Watertight grommets 94 may be used to seal electrical connection pathway extending in upper housing 36 between controller 66 and actuator 60 as well as between power source 76 and controller 66. Internal components and junctures may be sealed in the conventional manner, such as with silicone and silicone gaskets, for protection against the outside environment.

Figure 6:
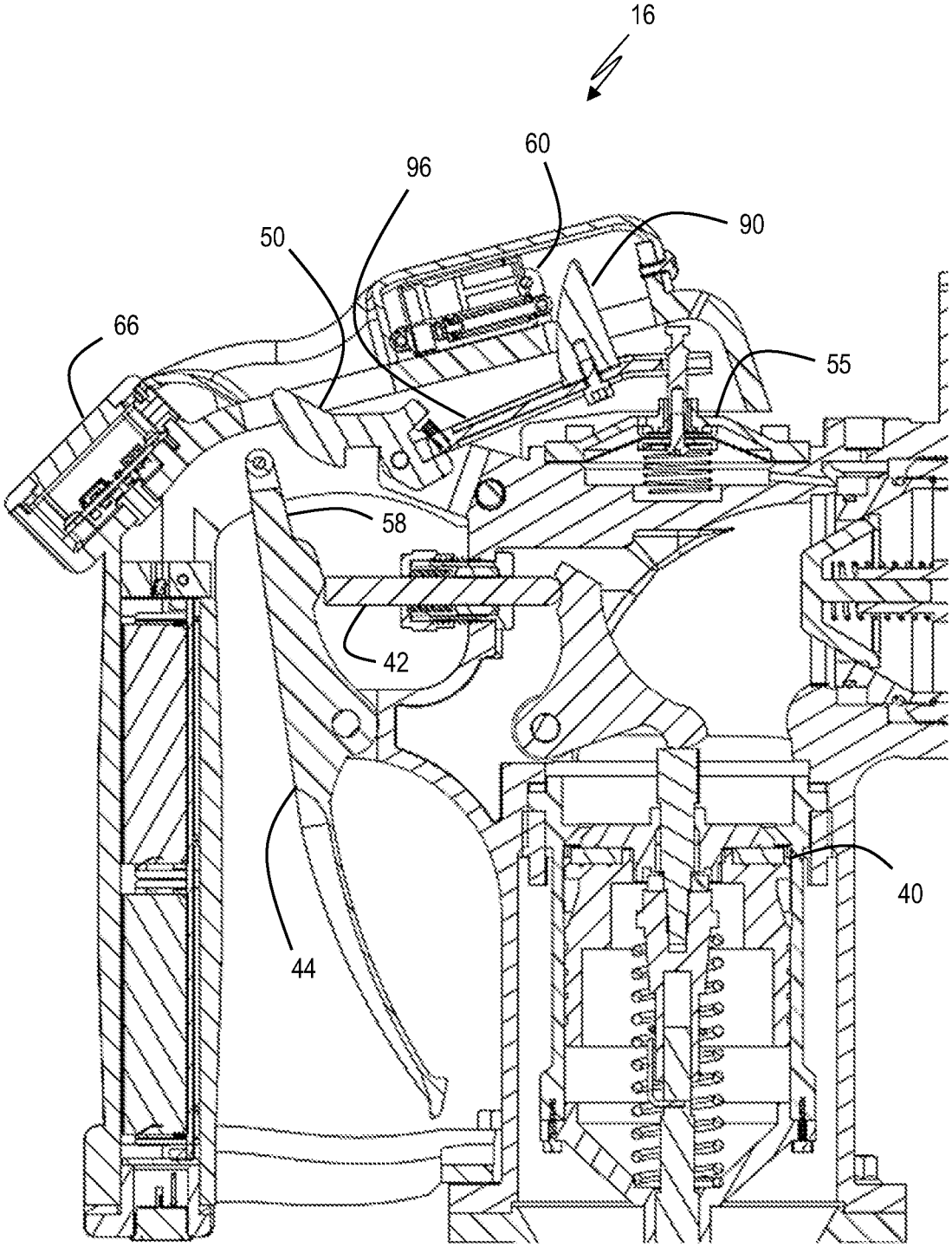
FIG. 6 is a cross-sectional view of a fuel nozzle according to the present invention in the unlatched position.
Figure 7:
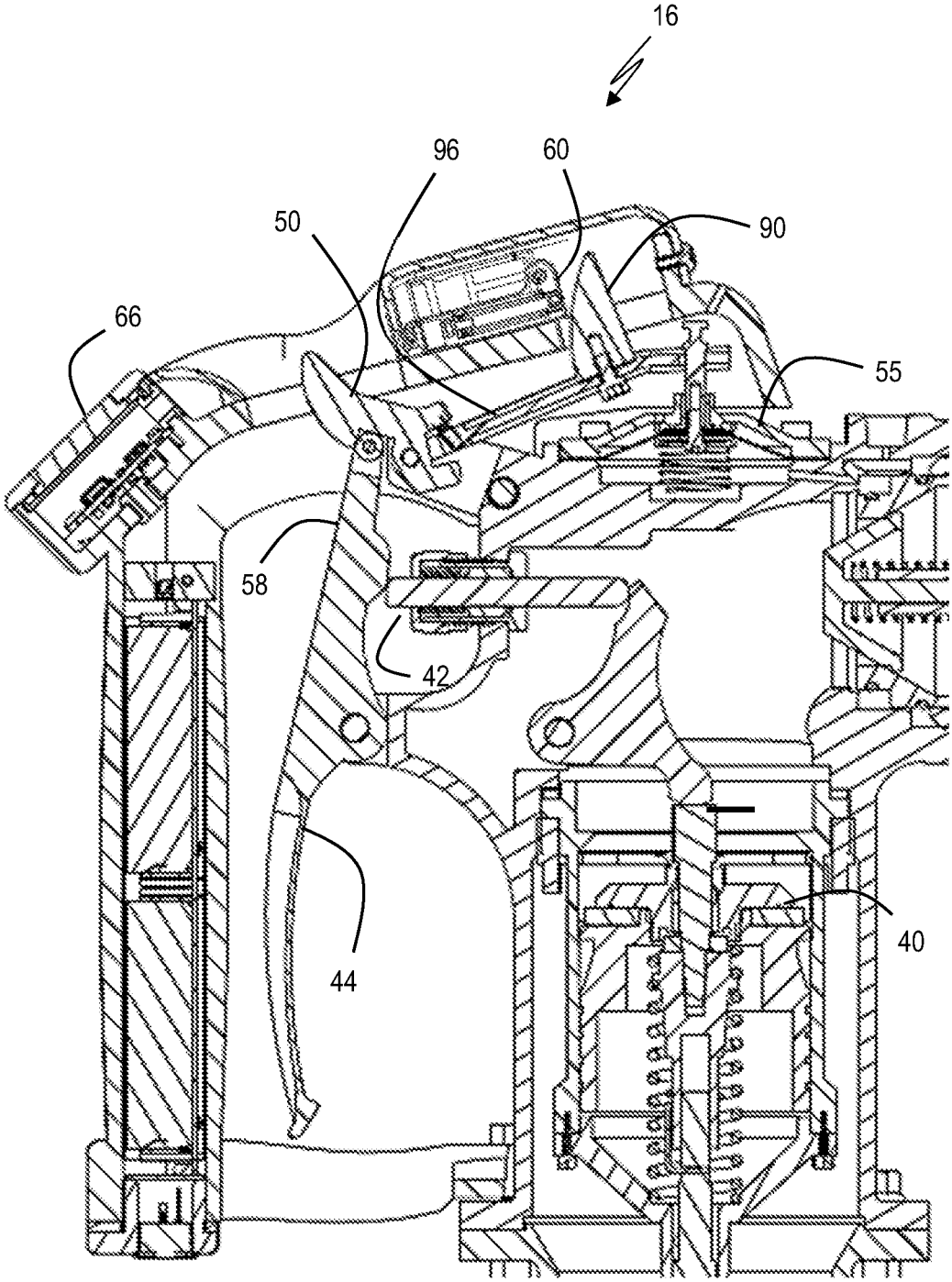
FIG. 7 is a cross-sectional view of a fuel nozzle according to the present invention in the latched position

Referring to FIGS. 6 and 7, actuator 60 is positioned adjacently to release trigger 90 so that actuation of actuator 60 by controller 66 will cause latch 50 to release lever 44 if a user has moved lever 44 into engagement with latch 50 for fueling operations. For example, a release bar 96 may be used to operatively interconnect latch 50 with both vacuum release 55 and release trigger 90. Thus, controller 66 can unlatch lever 44 from the position seen in FIG. 7 so that the lever returns to the position seen in FIG. 6 to cease fueling operations independently of any automatic shut-off by vacuum release 52 when the locomotive fuel tank becomes full and blocks the sensing port.

Figure 8:
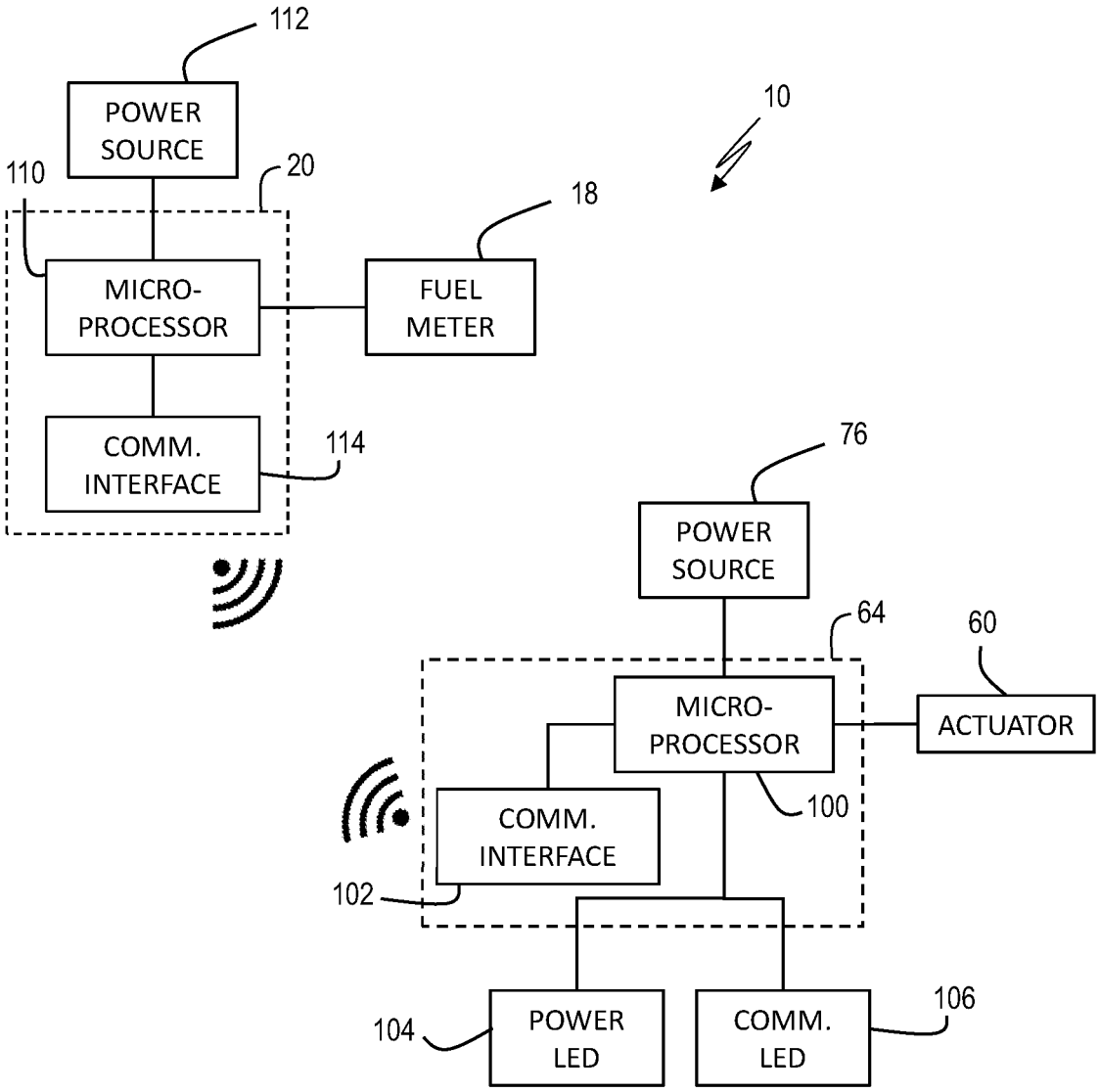
FIG. 8 is a schematic of the electronic components of a fuel management system and a fuel nozzle according to the present invention.

Referring to FIG. 8, controller 66 includes a microprocessor 100 in communication with actuator 60 and power source 76. Controller 66 further comprises a wireless communication interface 102 for wireless communication with a remote host, i.e., fuel management system 20. For example, wireless communication interface 102 may comprise a WiFi (802.11x) network chipset, but could also comprise other conventionally wireless communication hardware and associated protocols, such as Blutetooth®, BLE, ZigBee, Z-Wave, 6loWPAN, NFC, cellular such as 4G, 5G or LTE, RFID, LoRA, LoRaWAN, Sigfox, or NB-IoT, that are capable of engaging in communicating with similar hardware and protocols of fuel management system 20, as described below. In addition to being programmed to establish a wireless connection with fuel management system 20, controller 66 is programmed to receive a signal from fuel management system 20 indicating that fueling is complete. In response to such a signal, microprocessor 100 is further programmed to drive actuator 60 to release latch 50 and lever 44 so that valve 40 can to return to the closed position to shut off the flow path through body 32. Controller 66 may further comprise one or more status indicators, such as a power level indicator 104 that reflecting the charge status of power source 76 and a communication indicator 106 that reflects the current status of communications with fuel management system 20.

As further seen in FIG. 8, fuel management system 20 comprises a microprocessor 110 and local power source 112. Microprocessor 110 is interconnected to fuel meter 18 for receipt of an electrical signals reflecting the amount of fuel that has been delivered to the locomotive fuel tank. Microprocessor 110 is further coupled to a wireless communication interface 114 corresponding to and in communication with wireless communication interface 102 of nozzle 16. When a predetermined amount of fuel has been delivered, microprocessor 110 is programmed to respond to fuel meter 18 indicating the desired amount of fuel has been delivered by wirelessly signaling the completion of fueling to nozzle 16, such as by sending a command to microprocessor 100 of controller 66. Controller 66 will then activate actuator 60 to release latch 50, thereby allowing valve 40 to close so that nozzle 16 ceases the delivery of fuel. As a result, system 10 can be configured to precisely deliver any predetermined amount of fuel to a locomotive fuel tank rather than having to completely fill the locomotive fuel tank.

What is claimed is:

1. A fuel delivery system, comprising:

a body defining a flow path for the delivery of fuel therethrough;

a valve positioned in the flow path and moveable between a closed position and an open position in response to movement of a lever from a first position to a second position;

a latch for retaining the lever in the second position so that the valve is maintained in the open position;

a handle coupled to the body and supporting an actuator positioned to cause the latch to release the lever when the actuator is energized; and a controller mounted to the handle and programmed to energize the actuator in response to receipt of a wireless signal indicating that the delivery of fuel should be terminated.

2. The fuel delivery system of claim 1, further comprising a first wireless communication interface coupled to the controller and configured to engage in wireless communications with a remote host.

3. The fuel delivery system of claim 2, wherein the handle includes a power source interconnected to the controller and the actuator.

4. The fuel delivery system of claim 3, wherein the remote host comprises a fuel management system.

5. The fuel delivery system of claim 4, wherein the remote host is associated with an fuel supply station having a boom that supports the body and that can deliver fuel through the flow path of the body.

6. The fuel delivery system of claim 5, further comprising a fuel meter associated with the fuel supply station.

7. The fuel delivery system of claim 6, wherein the fuel management system is coupled to the fuel meter.

8. The fuel delivery system of claim 7, wherein the fuel management system includes a microprocessor coupled to the fuel meter and a second wireless communication interface coupled to the microprocessor and in communication with the first wireless communication interface.

9. The fuel delivery system of claim 8, wherein the microprocessor is programmed to wirelessly transmit the wireless signal indicating that the delivery of fuel should be terminated to the controller when the fuel meter indicates a predetermined amount of fuel has been delivered through the flow path.

10. The fuel delivery system of claim 9, further comprising a first visual indicator that provides an indication of the status of wireless communications between the first wireless communication interface and the second wireless communication interface.

11. The fuel delivery system of claim 10, further comprising a second visual indicator that provides an indication of an amount of power available from the power source.

12. A system for the delivery of fuel to a locomotive, comprising:

a fuel supply station having a fuel meter and a fuel management system is coupled to the fuel meter, wherein the fuel management system includes a microprocessor coupled to the fuel meter and configured to wirelessly transmit a shutoff signal; and a fuel nozzle fluidly coupled to the fuel supply station and having a valve moveable between a closed position and an open position, a latch for retaining the valve in the open position, and an actuator positioned to release the latch so that the valve will move to the closed position that is configured to release the latch in response to wireless receipt of the shutoff signal from the fuel supply station.

13. The system of claim 12, wherein the fuel nozzle comprises a handle coupled to the body that supports the actuator proximately to a release trigger interconnected to the latch.

14. The system of claim 13, wherein the fuel nozzle comprises a controller mounted to the handle and programmed to energize the actuator in response to wireless receipt of the shutoff signal.

* * * * *